US008973546B2

(12) United States Patent
Oka et al.

(10) Patent No.: US 8,973,546 B2
(45) Date of Patent: Mar. 10, 2015

(54) LASH ADJUSTER

(71) Applicant: Otics Corporation, Nishio-shi, Aichi (JP)

(72) Inventors: Hideki Oka, Handa (JP); Kimihiko Todo, Aichi (JP)

(73) Assignee: Otics Corporation, Aichi (JP)

( * ) Notice: Subject to any disclaimer, the term of this patent is extended or adjusted under 35 U.S.C. 154(b) by 0 days.

(21) Appl. No.: 14/175,560

(22) Filed: Feb. 7, 2014

(65) Prior Publication Data

US 2014/0224201 A1 Aug. 14, 2014

(30) Foreign Application Priority Data

Feb. 14, 2013 (JP) ..... 2013-026425

(51) Int. Cl.
*F01L 1/18* (2006.01)
*F01L 1/24* (2006.01)
*F01L 1/245* (2006.01)

(52) U.S. Cl.
CPC ..... *F01L 1/24* (2013.01); *F01L 1/2405* (2013.01); *F01L 2001/2427* (2013.01); *F01L 2001/256* (2013.01)
USPC ..... 123/90.45; 123/90.39; 123/90.43; 123/90.44; 123/90.46

(58) Field of Classification Search
CPC ..... F01L 1/24; F01L 1/2405; F01L 1002/20; F01L 2001/24; F01L 2001/2427
USPC ..... 123/90.39, 90.43, 90.44, 90.45, 90.46
See application file for complete search history.

(56) References Cited

U.S. PATENT DOCUMENTS 5,509,385 A 4/1996 LaVieri
5,706,773 A 1/1998 Dura et al.

(Continued)

FOREIGN PATENT DOCUMENTS

DE 2343269 3/1975
DE 19614668 10/1997

(Continued)

OTHER PUBLICATIONS

European Search Report corresponding to co-pending EP application No. 14000198.3 dated Apr. 14, 2014, listed in IDS for U.S. Appl. No. 14/175,610.

(Continued)

*Primary Examiner* — Ching Chang
(74) *Attorney, Agent, or Firm* — Smith, Gambrell & Russell, LLP

(57) ABSTRACT

A lash adjuster includes a body, a plunger inserted, into the body and having a bottom wall formed with a valve hole and a peripheral wall standing from the bottom wall and having an oil passage hole, the plunger defining a high-pressure chamber between the bottom wall and the body, a partitioning member inserted into the plunger and having an oil passage end located above the oil passage hole, the partitioning member defining an oil passage between itself and the plunger peripheral wall, the partitioning member having a low-pressure chamber reserving a hydraulic fluid flowing through the oil passage hole, the oil passage and the oil passage end, the low-pressure chamber causing the reserved hydraulic fluid to flow through the valve hole into the high-pressure chamber, and a spacer interposed between the plunger peripheral wall and the partitioning member so that the partitioning member is held in the plunger.

6 Claims, 5 Drawing Sheets

(56) References Cited

U.S. PATENT DOCUMENTS

| | | | | |
|---|---|---|---|---|
| 5,979,377 | A | 11/1999 | Barth et al. | |
| 8,001,941 | B2 * | 8/2011 | Fujii et al. | 123/90.52 |
| 2005/0178351 | A1 | 8/2005 | Mayer et al. | |
| 2014/0224202 | A1 | 8/2014 | Suzuki et al. | |
| 2014/0230766 | A1 | 8/2014 | Fujii et al. | |
| 2014/0230767 | A1 | 8/2014 | Yamamoto et al. | |
| 2014/0230768 | A1 | 8/2014 | Haga et al. | |

FOREIGN PATENT DOCUMENTS

| | | |
|---|---|---|
| DE | 10 2005 025 765 | 12/2006 |
| DE | 10 2006 004 751 | 8/2007 |
| DE | 10 2006 007 375 | 8/2007 |
| DE | 102006007376 | 8/2007 |
| DE | 10 2006 017 442 | 10/2007 |
| EP | 1564383 | 8/2005 |
| JP | 57181908 | 11/1982 |
| JP | 61118509 | 6/1986 |
| JP | 06-37504 | 5/1994 |
| JP | H05-288019 | 11/2003 |
| JP | 2004-197665 | 7/2004 |
| JP | 2008-064020 | 3/2008 |
| WO | 9215776 | 9/1992 |
| WO | 2007/118820 | 10/2007 |

OTHER PUBLICATIONS

May 2014 generated European Search Report for EP Application No. 14000223, listed in IDS for U.S. Appl. No. 14/175,641.

May 15, 2014 generated European Search Report for EP Application No. 14000227, listed in IDS for U.S. Appl. No. 14/175,653.

European Search Report corresponding to co-pending EP application No. 14000199.1 dated Apr. 22, 2014, listed in IDS for U.S. Appl. No. 14/175,670.

European Search Report corresponding to co-pending EP application No. 14000213.0 dated Apr. 22, 2014.

* cited by examiner

LASH ADJUSTER

CROSS-REFERENCE TO RELATED APPLICATIONS

This application is based upon and claims the benefit of priority from the prior Japanese Patent Application No. 2013-26425 filed on Feb. 14, 2013, the entire contents of which are incorporated herein by reference.

BACKGROUND

1. Technical Field

The present invention relates to a lash adjuster.

2. Related Art

A conventional lash adjuster includes a bottomed cylindrical body fixed to a cylinder head of an internal combustion engine and a plunger which is inserted into the body so that the plunger is movable up and down. The plunger has an upper end supporting a rocker arm. The plunger further has a peripheral wall formed with an oil passage hole and a bottom wall formed with a valve hole. Hydraulic fluid, such as oil, supplied through an oil filler hole of the cylinder head is stored in a low-pressure chamber in the plunger through the oil passage hole and also supplied through the valve hole into the body thereby to fill the body. A high-pressure chamber is defined by dividing an interior of the body by the bottom wall of the plunger. The plunger is moved up and down according to oil pressure in the high-pressure chamber. The hydraulic fluid in the low-pressure chamber in the plunger is drawn through the valve hole into the high-pressure chamber when the plunger is moved upward. In this case, there is a possibility that air entrainment may occur in the high-pressure chamber when the hydraulic fluid level is low in the low-pressure chamber.

In view of the aforementioned problem, the conventional art provides a lash adjuster provided with a cylindrical partitioning member inserted into the plunger. A space inside the partitioning member serves as a low-pressure chamber. An oil passage is formed between an inner periphery of the plunger and an outer periphery of the partitioning member. An oil passage end is located above the oil passage hole. As a result, a large amount of hydraulic fluid is supplied from the oil passage hole via the oil passage and the oil passage end into the low-pressure chamber. Since the hydraulic fluid level depends upon the oil passage end located above the oil passage hole, air entrainment can be prevented in the high-pressure chamber.

The above-described partitioning member is press-fitted into the plunger. In this case, if without execution of treatment such as shrinkage fitting, the dimensional control is required under the condition that there is little press-fit tolerance between an inner diameter of the plunger and an outer diameter of the partitioning member or a press-fit allowance is zero or close to zero. This requires a high machining accuracy. In particular, the partitioning member is provided with a stepped portion located midway in an up-down direction. Accordingly, the partitioning member has a possibility of buckling beginning at the stepped portion when forcedly fitted into the plunger without a suitable control of the press-fit tolerance.

SUMMARY

Therefore, an object of the invention is to provide a lash adjuster which can relax the machining accuracy of the plunger and the partitioning member thereby to render the machining easier.

The invention provides a lash adjuster including a body formed into a bottomed cylindrical shape, a plunger which is inserted into the body so as to be movable up and down and has a bottom wall formed with a valve hole and a peripheral wall standing from an outer periphery of the bottom wall and having an oil passage hole formed therethrough, so that the plunger is formed into a bottomed cylindrical shape, the plunger defining a high-pressure chamber between the bottom wall and the body, a partitioning member formed into a tubular shape and inserted into the plunger, the partitioning member having an oil passage end located above the oil passage hole in a state where the partitioning member is inserted in the plunger, the partitioning member defining an oil passage between itself and the peripheral wall of the plunger outside the partitioning member, the partitioning member having a low-pressure chamber located inside the partitioning member, the low-pressure chamber reserving a hydraulic fluid flowing thereinto through the oil passage hole, the oil passage and the oil passage end, the low-pressure chamber causing the hydraulic fluid reserved therein to flow through the valve hole into the high-pressure chamber, and a spacer interposed between the peripheral wall of the plunger and the partitioning member so that the partitioning member is held in the plunger.

The spacer interposed between the peripheral wall of the plunger and the partitioning member causes the partitioning member to be held by the spacer. Accordingly, the dimensional control need not be rendered stricter between the inner diameter of the plunger and the outer diameter of the partitioning member, with the result that the machining of the plunger and the partitioning member can be rendered easier.

DETAILED DESCRIPTION

Figure 1:
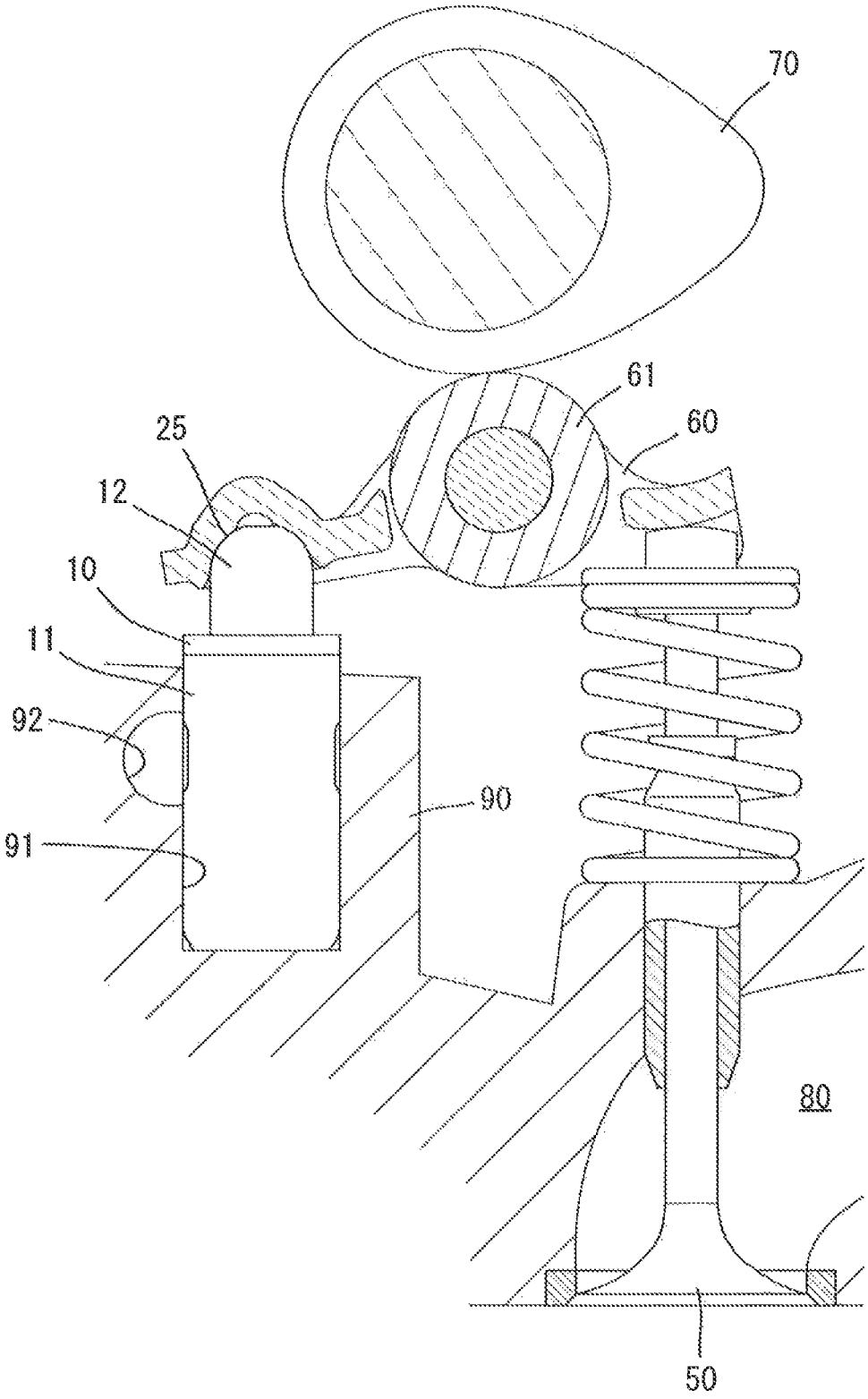
FIG. 1 schematic sectional view of an internal combustion engine in which a lash adjuster in accordance with one embodiment is incorporated.

Embodiment 1 of the present invention will be described with reference to FIGS. 1 and 2 of the accompanying drawings. Referring to FIG. 1, a lash adjuster 10 in accordance with embodiment 1 is shown. As shown, the lash adjuster 10 is incorporated in a valve gear of an internal combustion engine. The valve gear includes a valve 50, a rocker arm 60 and a cam 70 in addition to the lash adjuster 10.

The lash adjuster 10 is inserted into a mounting recess 91 of a cylinder head 90 from above. The valve 50 is provided to be capable of opening and closing an intake/exhaust port 80 of the cylinder head 90. The rocker arm 60 is disposed so as to extend between an upper end (a support portion 25 of a plunger 12 as will be described later) of the lash adjuster 10 and an upper end of the valve 50 in a right-left direction. The cam 70 is disposed above the rocker arm 60 so as to be sidable together with a roller 61 of the rocker arm 60. Upon rotation of the cam 70, the rocker arm 60 is swung in an up-down direction with the upper end of the lash adjuster 10 serving as a fulcrum. With swing of the rocker arm 60, the valve 50 is moved up and down thereby to open and close the intake/exhaust port 80.

The lash adjuster 10 will now be described more concretely. The lash adjuster 10 includes a body 11, a plunger 12, a partitioning member 13 and a spacer 100 as shown in FIG. 2. The body 11 has a disc-shaped bottom wall 14 and a cylindrical peripheral wall 15 standing from an outer periphery of the bottom wall 14. The body 11 is formed into a bottomed cylindrical shape as a whole. The body 11 is fittable into the mounting recess 91 of the cylinder head 90. The peripheral wall 15 of the body 11 has an outer oil passage hole 16 formed therethrough. The outer oil passage hole 16 is disposed in communication with an oil filler hole 92 of the cylinder head 90. Furthermore, the body 11 has an outer periphery formed with an annular recess 17 which extends over the entire periphery thereof and in which the outer oil passage hole 16 is open. Accordingly, the outer oil passage hole 16 and the oil filler hole 92 are retained in communication via the annular recess 17 even when the body 11 is rotated in the mounting recess 91.

The plunger 12 has a disc-shaped bottom wall 18 and a cylindrical peripheral wall 19 standing from an outer periphery of the bottom wall 18 and is formed into a bottomed cylindrical shape as a whole. The bottom wall 18 includes a central part through which a valve hole 20 is formed. The valve hole 20 communicates between a high-pressure chamber 22 and a low-pressure chamber 23 via a valve element 21 as will be described later. The peripheral wall 19 has an upper end formed with a semispherical support potion 25 which is radially squeezed and has a centrally located through hole 24. The support potion 25 includes an outer semispherical surface on which a rocker arm 60 is adapted to slide during swinging.

The peripheral wall 19 also has an oil passage hole 26 formed therethrough. The peripheral wall 19 has an outer peripheral surface with an annular recess 27 formed over an entire circumference thereof. The oil passage hole 26 is open to the recess 27. The oil passage hole 26 communicates via the recess 27 with the outer oil passage hole 16 of the body 11, so that the oil passage hole 26 and the outer oil passage hole 16 are retained in communication even when the plunger 12 is rotated in the body 11, respectively.

Figure 2:
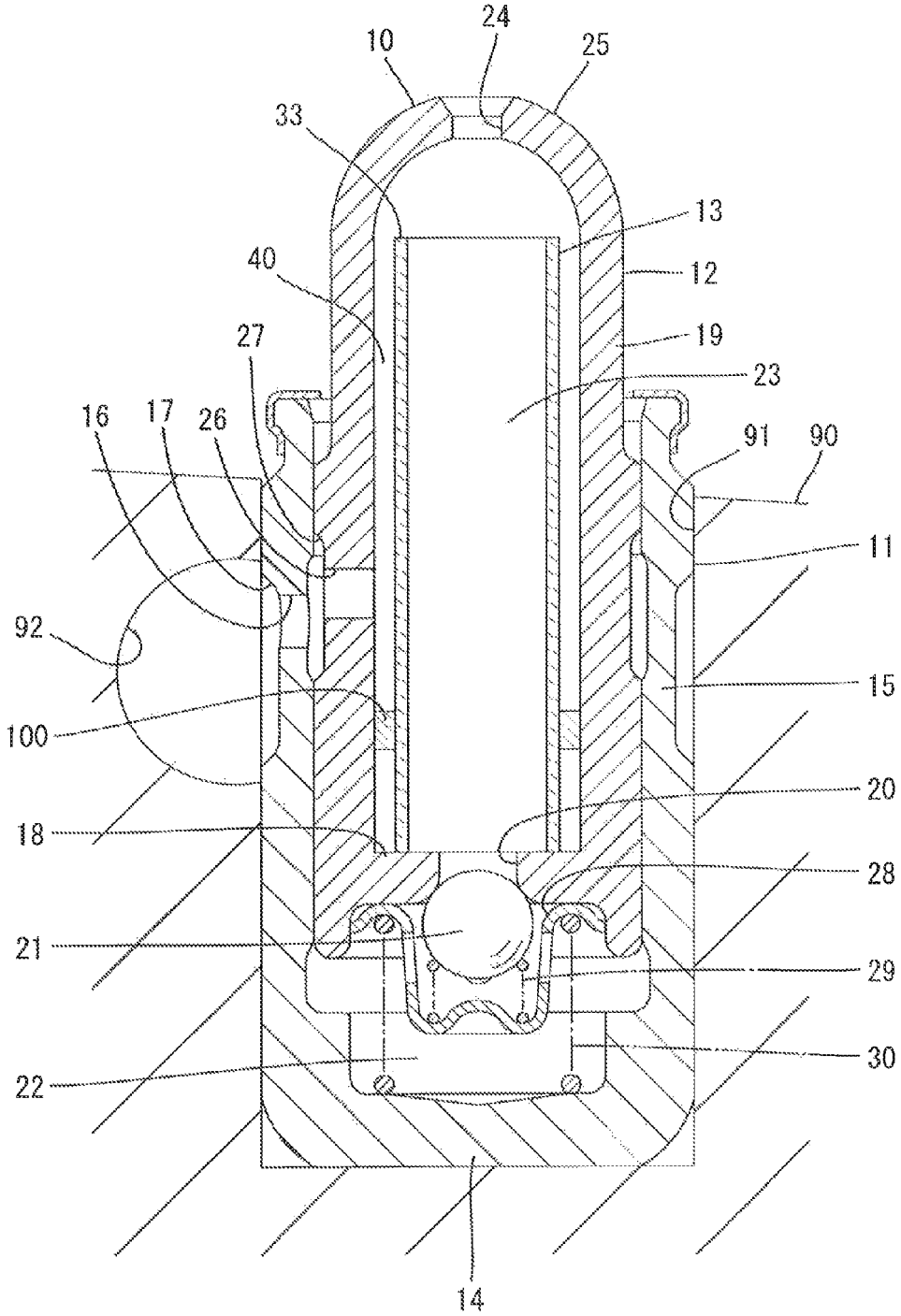
FIG. 2 is a sectional view of the lash adjuster of embodiment 1.

A high-pressure chamber 22 is defined between the bottom wall 18 of the plunger 12 and the body 11 in the state where the plunger 12 is inserted in the body 11, as shown in FIG. 2. A spherical valve element 21 is provided in the high-pressure chamber 22. The valve element 21 is housed in a cage-like retainer 28 and biased by a first spring 29 in a direction such that the valve hole 20 is closed. The high-pressure chamber 22 is also provided with a second spring 30 located between the bottom wall 14 of the body 11 and an upper edge of the retainer 28. The plunger 12 is biased upward by the second spring 30.

The partitioning member 13 is inserted into the plunger 12. The partitioning member 13 is a tubular body made of a metal and is formed into a cylindrical shape extending in an up-down direction. In the state where the partitioning member is inserted in the plunger 12, a lower end of the partitioning member 13 is in abutment with the bottom wall 18 of the plunger 12 and an upper end of the partitioning member 13 is located at a position near the support portion 25 of the plunger 12, at which position the upper end of the partitioning member 13 is located above the oil passage hole 26. More specifically, the partitioning member 13 extends in an up-down direction with a uniform diameter has a circular section which is uniform over an entire height thereof. The partitioning member 13 has no stepped portion midway in the up-down direction. The partitioning member 13 has an outer diameter set to be smaller than an inner diameter of the peripheral wall 19 of the plunger 12.

The spacer 100 is interposed between the peripheral wall 19 of the plunger 12 and the partitioning member 13 in the state where the partitioning member 13 is inserted in the plunger 12. The spacer 100 is formed into an annular elastic ring comprised of a sintered metal having a lower hardness than the plunger 12 and the partitioning member 13. The spacer 100 has a radial width that is slightly larger than the difference between the inner diameter of the peripheral wall 19 of the plunger 12 and the outer diameter of the partitioning member 13 in a natural state.

The spacer 100 is incorporated in an upper position located below the oil passage hole 26 and spaced from the bottom wall 18 of the plunger 12, so that an oil passage 40 is defined by the spacer 100 between the peripheral wall 19 of the plunger 12 and the partitioning member 13. The oil passage 40 has a passage width that is equal to a width of the spacer 100 interposed between the plunger 12 and the partitioning member 13. The oil passage 40 has a lower end liquidtightly sealed by the spacer 100. The oil passage 40 has a passage side surface defined by an inner periphery of the peripheral wall 19 of the plunger 12 and an outer periphery of the partitioning member 13. In other words, the passage width of the oil passage 40 is defined by the spacer 100. Furthermore, the oil passage 40 faces an upper end of the partitioning member 13. The upper end of the partitioning member 13 serves as an oil passage end 33. Still furthermore, a space defined inside the partitioning member 13 is constituted as a low-pressure chamber 23.

The partitioning member 13 and the spacer 100 are inserted into the plunger 12 from an upper end opening of the plunger 12 on which the support portion 25 has not been formed. In this case, the partitioning member 13 is inserted inside the spacer 100 which is in a heated state. Thereafter, the spacer 100 is cooled thereby to be binding fitted with the partitioning member 13. In the state where the partitioning member 13 and the spacer 100 have been inserted into the plunger 12, the upper end of the plunger 12 is squeezed in a diameter-reducing direction, so that the support portion 25 is formed together with a through hole 24.

The hydraulic fluid flowing through the oil filler hole 92 of the cylinder head 90 is supplied sequentially through the outer oil passage hole 16, the oil passage hole 26, the oil passage 40 and the oil passage end 33 to be reserved in the low-pressure chamber 23. The hydraulic fluid reserved in the low-pressure chamber 23 is further supplied through the valve hole 20 to fill the high-pressure chamber 22. In this case, since the oil passage end 33 of the partitioning member 13 is located above the oil passage hole 26, the hydraulic fluid is reserved in the low-pressure chamber 23 to a level above the oil passage hole 26.

The valve element 21 closes the valve hole 20 thereby to close the high-pressure chamber 22 when a downward pressure is applied from the rocker arm 60 side to the plunger 12 in the state where the hydraulic fluid has been introduced into the low-pressure chamber 23 and the high-pressure chamber 22. As a result, the plunger 12 is stopped lowering by the hydraulic pressure of the high-pressure chamber 22. On the other hand, when the plunger 12 is raised with decrease in the pressure from the rocker arm 60 side, the capacity of the high-pressure chamber 22 is increased. When the capacity of the high-pressure chamber 22 is increased, the valve element 21 is lowered thereby to open the valve hole 20. As a result, the hydraulic fluid in the low-pressure chamber 23 flows through the valve hole 20 into the high-pressure chamber 22 thereby to fill the high-pressure chamber 22. Upon stop of the upward movement of the plunger 12, the valve element 21 is biased by the first spring 29 thereby to be moved upward and close the valve hole 20, so that the high-pressure chamber 22 is closed. Thus, the plunger 12 is moved up and down relative to the body 11, whereby the support position of the plunger 12 relative to the rocker arm 60 fluctuates with the result that a valve clearance is adjusted.

In embodiment 1, the partitioning member 13 is held in the plunger 12 by the spacer 100 interposed between the peripheral wall 19 of the plunger 12 and the partitioning member 13 as described above. Accordingly, when differing from the case where the partitioning member is press-fitted into the plunger 12, the dimensional control of the inner diameter of the peripheral wall 19 of the plunger 12 and the outer diameter of the partitioning member 13 need not be rendered stricter. This can relax the machining accuracy of the plunger 12 and the partitioning member 13, rendering the machining of the plunger 12 and the partitioning member 13 easier. Furthermore, since the passage width of the oil passage 40 is defined by the spacer 100, no members or machining dedicated to define the oil passage 40 is required with the result that the construction of the lash adjuster can be simplified.

Furthermore, since the spacer 100 has sealing properties of liquidtightly sealing the lower end of the oil passage 40, the reliability of hydraulic fluid supply through the oil passage 40 can be improved. Still furthermore, since the partitioning member 13 is cylindrical in shape and extends in the up-down direction without any stepped portion, no particularly complicate working is required in the manufacture of partition member 13, with the result that the manufacture man-hour can be reduced and the manufacturing costs can be suppressed. Furthermore, since an inner capacity of the low-pressure chamber 23 located inside the partitioning member 13 can be increased, the above-described construction is suitably applicable to small-sized lash adjusters. Since the partitioning member 13 has no stepped portion midway in the up-down direction, the partitioning member 13 can be prevented from buckling in the course of insertion into the plunger 12. Additionally, since the spacer 100 is disposed at the upper position spaced from the bottom wall 18 of the plunger 12, the lower end of the oil passage 40 can be prevented from being uselessly departed below the oil passage hole 26.

Embodiment 2

Figure 3:
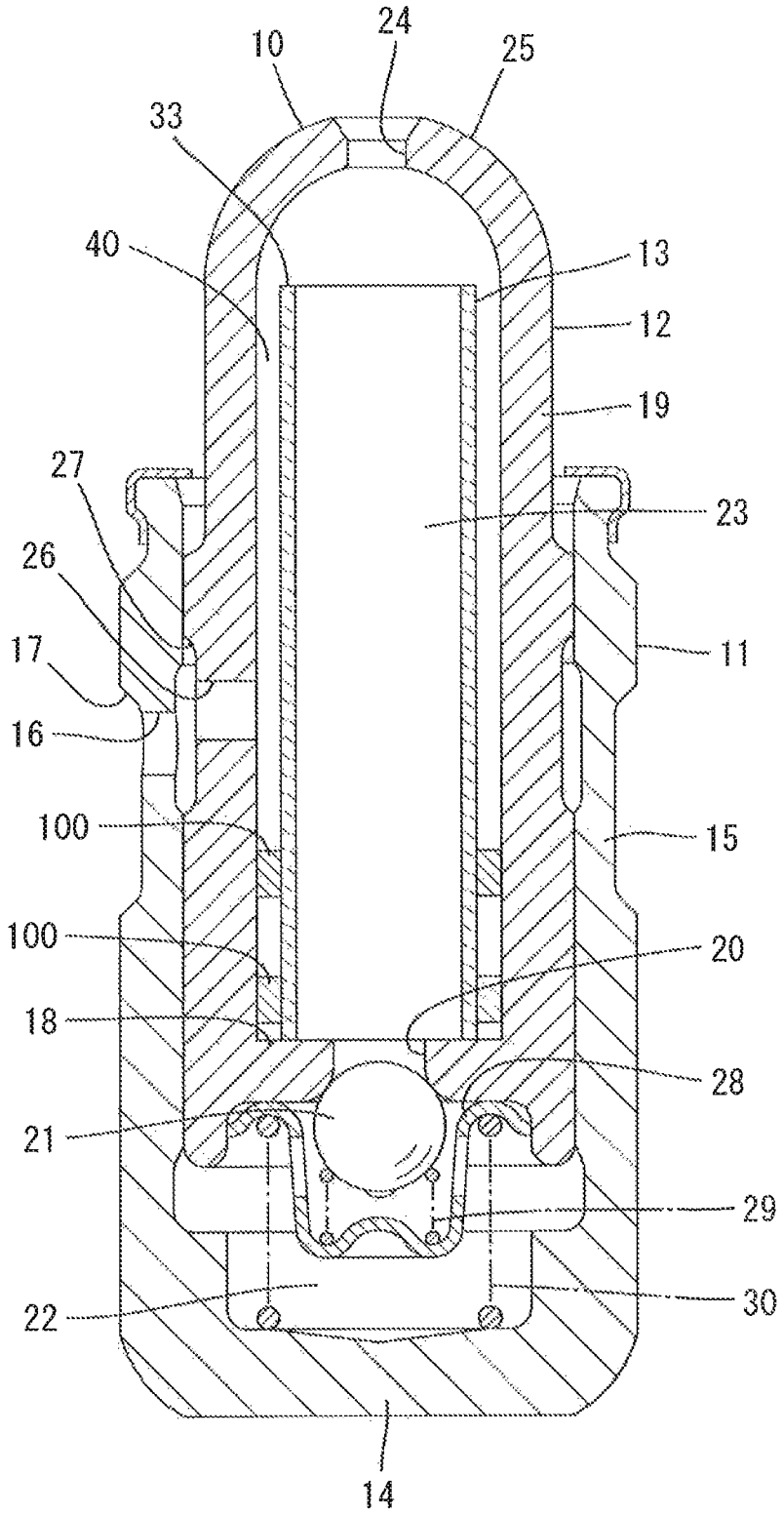
FIG. 3 is a sectional view of the lash adjuster of embodiment 2.

FIG. 3 illustrates embodiment 2. A plurality of spacers 100 is interposed between the peripheral wall 19 of the plunger 12 and the partitioning member 13 in embodiment 2. More specifically, two spacers 100 are provided vertically in parallel below the oil passage hole 26. According to embodiment 2, the partitioning member 13 is stably supported by the plural spacers 100 in the plunger 12. The lash adjuster of embodiment 2 is similar to that of embodiment 1 except for the number of the spacers 100. Accordingly, identical or similar parts in embodiment 2 are labeled by the same reference symbols as those in embodiment 1.

Embodiment 3

Figure 4:
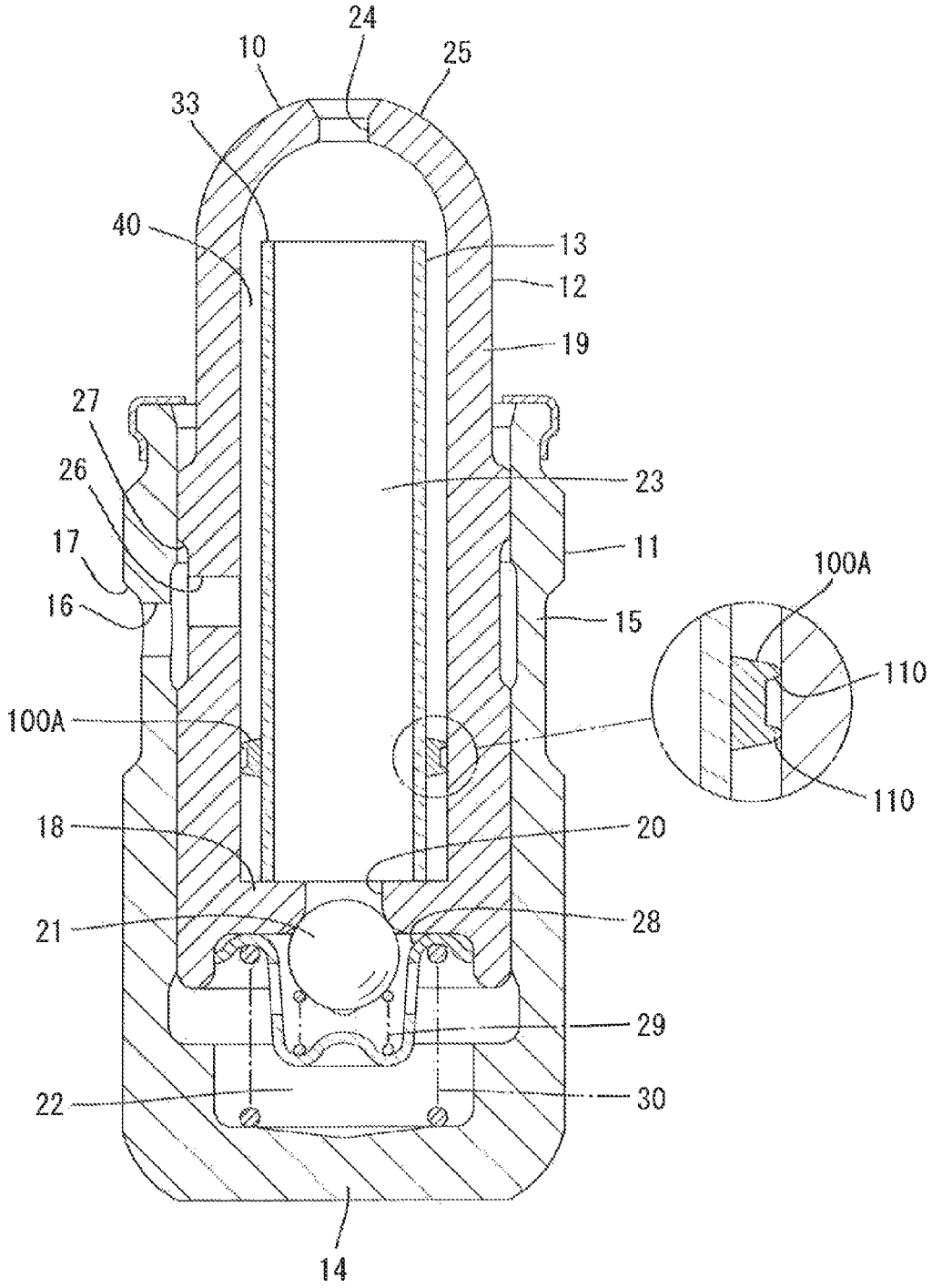
FIG. 4 is a sectional view of the lash adjuster of embodiment 3.

FIG. 4 illustrates a third embodiment. Embodiment 3 differs from embodiment 1 in the shape of the spacer 100A. More specifically, the spacer 100A has lips 110 which elastically adhere closely to the inner periphery of the peripheral wall 19 of the plunger 12 in a collapsed state in the state where the spacer 100A is interposed between the peripheral wall 19 of the plunger 12 and the partitioning member 13. Two lips 110 as shown in FIG. 4 are each formed into a protrusion provided around the outer periphery of the spacer 100A vertically in parallel. According to embodiment 3, the oil passage 40 can be maintained in a good liquidtight state by the lips 110. The lips may be provided around the inner periphery of the spacer 100 so as to adhere closely to the outer periphery of the partitioning member 13, instead.

Embodiment 4

Figure 5:
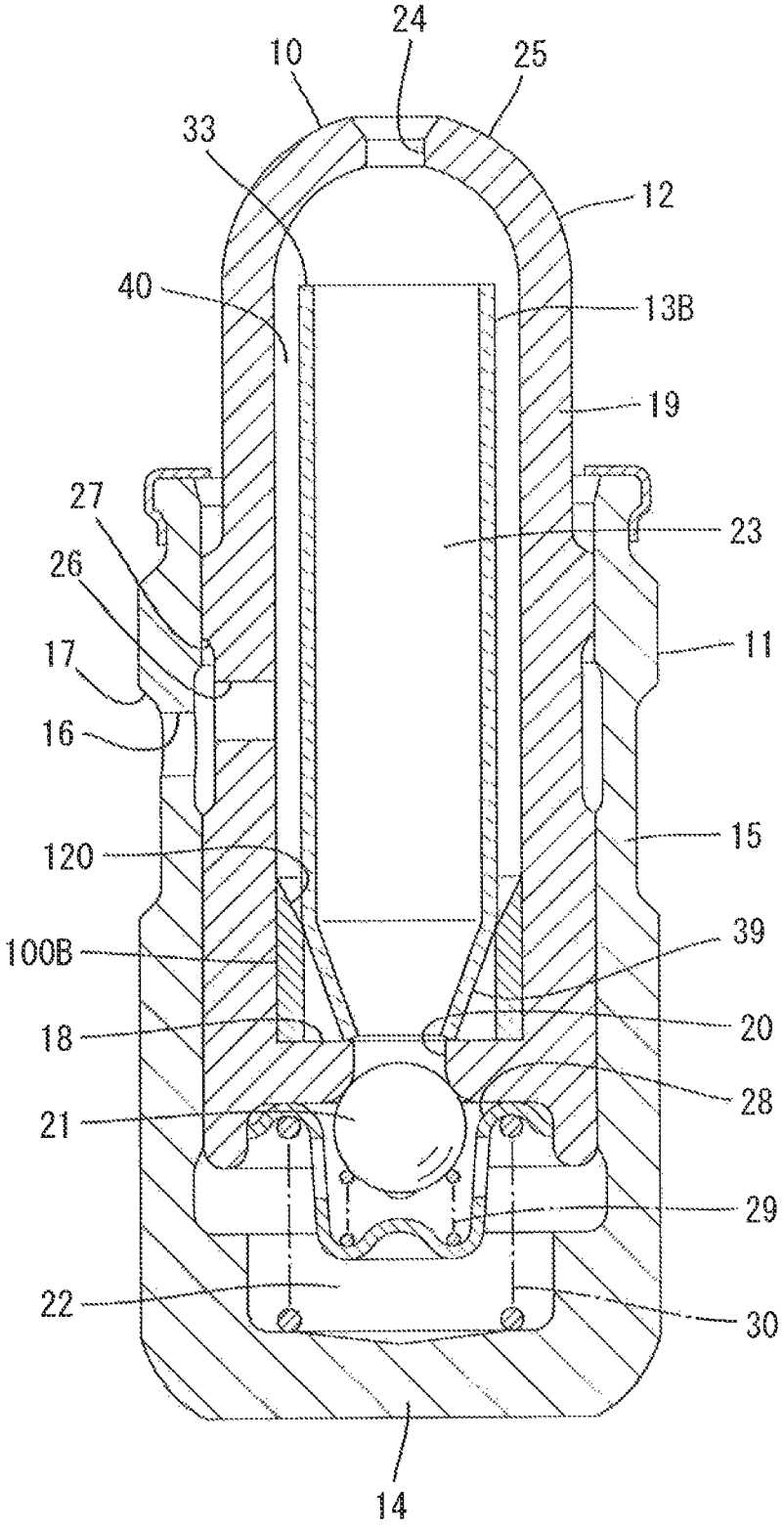
FIG. 5 is a sectional view of the lash adjuster of embodiment 4.

FIG. 5 illustrates embodiment 4. Embodiment 4 differs from embodiment 1 in the shape and arrangement of the spacer 100B. Furthermore, the shape of the partitioning member 13 in embodiment 4 slightly differs from that of the partitioning member 13 in embodiment 1. A reverse-tapered guide portion 120 having a diameter upwardly increased is provided on an inner periphery of the upper end of the spacer 100B. The spacer 100B is pushed deep into the plunger 12 thereby to be disposed in abutment on the bottom wall 18. On the other hand, the partitioning member 13B has a lower end formed with a tapered guided portion 39 having a diameter downwardly reduced. When the spacer 100B which is in a heated state and the partitioning member 13B are inserted in turn into the plunger 12, the guided portion 39 slides on the guide portion 120, so that the partitioning member 13B is smoothly guided inside the spacer 100B. The spacer 100B is subsequently cooled thereby to be binding fitted with the partitioning member 13B, with the result that the partitioning member 13B is stably held in the plunger 12 by the spacer 100B.

Other Embodiments

Embodiments 1 to 4 may each be deformed as follows.

(1) The oil passage end may be recessed in the upper end of the partitioning member into a cutout shape.

(2) The upper end of the partitioning member may radially be squeezed along the semispherical shape of the support portion.

(3) The spacer may be comprised of a resin ring which is elastically deformable in the radial direction.

What is claimed is:

1. A lash adjuster comprising:

a body formed into a bottomed cylindrical shape;

a plunger which is inserted into the body so as to be movable up and down and has a bottom wall formed with a valve hole and a peripheral wall standing from an outer periphery of the bottom wall and having an oil passage hole formed therethrough, so that the plunger is formed into a bottomed cylindrical shape, the plunger defining a high-pressure chamber between the bottom wall and the body;

a partitioning member formed into a tubular shape and inserted into the plunger, the partitioning member having an oil passage end located above the oil passage hole in a state where the partitioning member is inserted in the plunger, the partitioning member defining an oil passage between itself and the peripheral wall of the plunger outside the partitioning member, the partitioning member having a low-pressure chamber located inside the partitioning member, the low-pressure chamber reserving a hydraulic fluid flowing thereinto through the oil passage hole, the oil passage and the oil passage end, the low-pressure chamber causing the hydraulic fluid reserved therein to flow through the valve hole into the high-pressure chamber; and a spacer interposed between the peripheral wall of the plunger and the partitioning member so that the partitioning member is held in the plunger.

2. The lash adjuster according to claim 1, wherein the oil passage has a passage width defined by the spacer.

3. The lash adjuster according to claim 1, wherein the spacer has sealing properties of liguidtightly sealing a lower end of the oil passage.

4. The lash adjuster according to claim 1, wherein the spacer is an elastic ring.

5. The lash adjuster according to claim 1, wherein the spacer is disposed at an upper position spaced from the bottom wall of the plunger.

6. The lash adjuster according to claim 1, wherein the partitioning member is formed into a cylindrical shape and extends in an up-down direction without any stepped portion.

* * * * *